US005806683A

United States Patent [19]

Gale

[11] Patent Number: 5,806,683

[45] Date of Patent: Sep. 15, 1998

[54] WRAPPED PACKAGE AND METHOD USING MOLDED FIBER INNER STRUCTURE

[76] Inventor: Gregory W. Gale, 3380 Atlas Peak Rd., Napa, Calif. 94558

[21] Appl. No.: 767,453

[22] Filed: Dec. 16, 1996

[51] Int. Cl.[6] ..... B65D 81/02

[52] U.S. Cl. ..... 206/587; 206/592; 229/87.02

[58] Field of Search ..... 206/521, 585, 206/587–594; 229/87.02, 406

[56] References Cited

U.S. PATENT DOCUMENTS

| | | | |
|---|---|---|---|
| 2,863,595 | 12/1958 | Emery | 206/587 |
| 3,016,177 | 1/1962 | Chaplin | 229/406 |
| 3,587,838 | 6/1971 | Miyata | 206/592 |
| 3,949,879 | 4/1976 | Peterson et al. | 206/521 |
| 4,905,835 | 3/1990 | Pivert et al. | 206/591 |
| 4,953,705 | 9/1990 | Evamy | 206/594 |
| 5,532,044 | 7/1996 | Jen | 206/587 |
| 5,624,035 | 4/1997 | Kim | 206/591 |

*Primary Examiner*—Paul T. Sewell
*Assistant Examiner*—Luan K. Bui
*Attorney, Agent, or Firm*—Flehr Hohbach Test Albritton & Herbert LLP

[57] ABSTRACT

A wrapped package for at least one product to be packaged comprising a molded fiber inner structure to provide a six-sided folded up rectangular package and sheet material at least partially enclosing the inner structure and providing planar surfaces on which imprinting can appear. The molded fiber inner structure is comprised of first and second spaced-apart parallel side walls and third and fourth spaced- apart parallel side walls. The first and second side walls extend at 90° angles with respect to the third and fourth side walls. Fifth and sixth spaced-apart parallel end walls extend at 90° angles with respect to the first and second and third and fourth side walls. Each of the side and end walls have at least one raised pyramid-like protrusion with four surfaces inclined at angles in excess of 30°. The angles of adjacent surfaces are complementary to provide a combined angle of 90°. The raised protrusions have recesses therein adapted to receive the product to be packaged.

11 Claims, 4 Drawing Sheets

WRAPPED PACKAGE AND METHOD USING MOLDED FIBER INNER STRUCTURE

This invention relates to a wrapped package and method using a molded fiber inner structure formed of recycled materials.

At the present time in providing packaging for small consumer articles it has been typical to utilize corrugated cardboard boxes utilizing corrugated partition liners and corrugated wraps inside as well as plastic bubble wraps, plastic fillers and blocks to absorb shock. There is a great need to reduce the need for such materials utilizing molded fibers which will make use of recycled materials.

In general, it is an object of the present invention to provide a wrapped package and method utilizing a molded fiber inner structure which can be fully or partially wrapped.

Another object of the invention is to provide a wrapped package and method of the above character in which the molded fiber inner structure is formed of recycled materials.

Another object of the invention is to provide a wrapped package and method of the above character in which the molded fiber inner structure can be formed flat and then can be folded onto itself to form at least a four-sided enclosure and preferably a six-sided enclosure.

Another object of the invention is to provide a wrapped package and method of the above character in which friction locks are utilized to reduce the requirement for glue or even to eliminate the use of glue in retaining the molded fiber inner structure in a four-sided or six-sided folded condition.

Another object of the invention is to provide a wrapped package and method in which an outer flat liner is utilized for encasing the folded molded fiber inner structure to provide flat surfaces that can be imprinted.

Another object of the invention is to provide a wrapped package and method in which the molded fiber inner structure is provided with pyramid-like protrusions having chamfered side walls permitting the folding of adjacent walls so that adjacent walls extend at 90° with respect to each other.

Another object of the invention is to provide a wrapped package and method of the above character in which the molded fiber inner structure has protrusions formed in the shape of truncated four-sided pyramids formed on opposite walls and which can be provided with planar facets having indentations therein that are customized for receiving the product to be packaged within the package.

Another object of the invention is to provide a wrapped package and method of the above character in which the resulting product is extraordinarily strong and serves to buttress and protect articles or products contained therein from damage resulting from shock and the like.

Another object of the invention is to provide a wrapped package and method of the above character in which the outer liner gives an aesthetic appearance to the package and permits and provides smooth surfaces for graphic illustrations on the exterior.

Another object of the invention is to provide a wrapped package and method of the above character which lends itself to use in automatic packaging machinery.

Additional objects and features of the invention will appear from the following description in which the preferred embodiments are set forth in detail in conjunction with the accompanying drawings.

In general, the wrapped package of the present invention is utilized for packaging at least one product and is comprised of a molded fiber inner structure capable of being folded into a four-sided rectangular box and preferably a six-sided rectangular box. The inner structure comprises first and second spaced apart parallel side walls and third and fourth spaced apart parallel side walls disposed at 90° angles with respect to the first and second side walls. Each of said first, second, third and fourth side walls have at least one four-sided pyramid-shaped protrusion formed therein having four side surfaces inclined at an angle from the plane of the wall so that the combined angles of facing side surfaces of adjacent side walls form a combined angle of 90°. The protrusions are formed with a conformation so that they can receive the product and support the same within the protrusions s. A liner wraps the exterior surfaces of the molded fiber inner structure to provide an aesthetic appearance for the package and also provides surfaces upon which graphic images may be imprinted.

Figure 1:
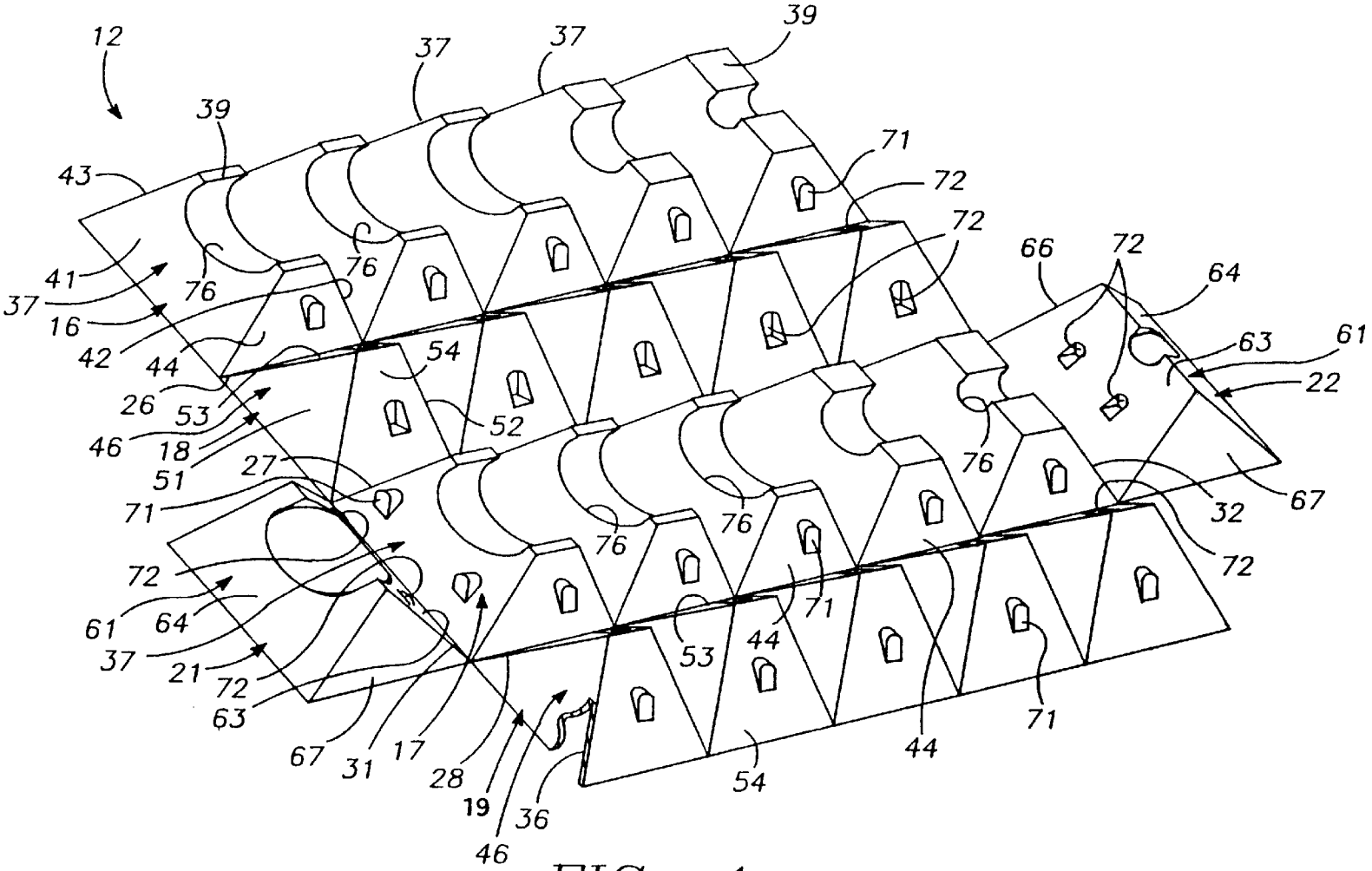
FIG. 1 is an isometric view of a molded fiber inner structure in a planar unfolded position for use in the wrapped package incorporating the present invention.
Figure 2:
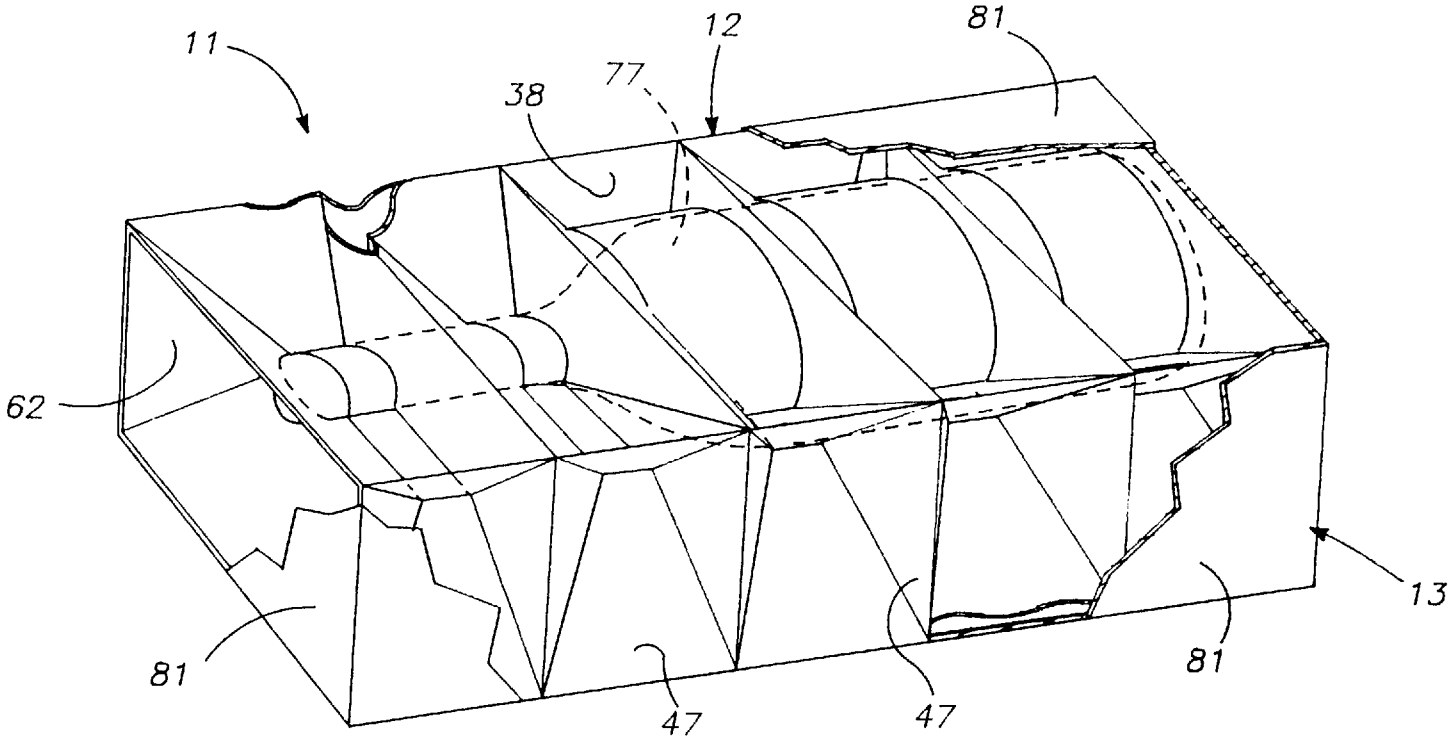
FIG. 2 is an isometric view showing the wrapped package incorporating the present invention utilizing the molded fiber inner structure shown in FIG. 1 in a folded six-sided condition for packaging a wine bottle.

More specifically, the wrapped package 11 of the present invention consists of a molded fiber inner structure 12 and a wrapping sheet or liner 13 as shown in FIGS. 1 and 2. In FIG. 1, the molded fiber inner structure 12 is shown in a flat unfolded position.

The molded fiber inner structure 12 uses pulp which can be obtained from recycled newspapers, telephone books, cardboard, corrugated cardboard boxes and even from short fibers from wood pulp which are unsuitable for making paper. Utilizing such pulp, the inner structure 12 can be fabricated in a conventional manner utilizing well-known molded pulp techniques and molds to provide the configuration shown in FIG. 1.

The inner structure 12 is provided with first and second sides 16 and 17 which form parallel spaced apart opposite side walls when the structure is folded as hereinafter described and third and fourth side walls 18 and 19 which when folded as hereinafter described form spaced apart parallel side walls which extend at 90° angles with respect to the first and second side walls and to provide a four-sided enclosure. The inner structure 12 is also provided with fifth and sixth side walls 21 and 22 which are also adapted to extend in parallel spaced apart positions and serve to close the opposite ends of the four-sided enclosure formed by the first, second, third and fourth side walls 16, 17, 18 and 19 to provide a six-sided enclosure.

Preferably for handling purposes, the first, second, third, fourth, fifth and sixth side walls are adjoined so that the structure forms a single piece which lies flat as shown in FIG. 1. As shown, the side wall 16 adjoins the side wall 18 along a fold line 26. The side wall 18 adjoins the side wall 17 along a fold line 27 and the side wall 17 adjoins the side wall 19 along a fold line 28. The side wall 21 adjoins the side wall 17 along a fold line 31 and similarly, the side wall 22 adjoins the side wall 17 along a fold line 32. It should be appreciated that the side walls 16, 17, 18, 19, 21 and 22 need not necessarily be adjoined in the manner described. For example the side walls 21 and 22 can be adjoined to any of the other three side walls and similarly, the first, second, third and fourth side walls can have the separation between the side walls between any of the four side walls. It is merely important that all of the side walls 16, 17, 18, 19, 21 and 22 be adjoined in such a manner so that there is only a single piece which is utilized for the inner structure.

Each of the side walls 16, 17, 18 and 19 and 21 is provided with at least one four-sided pyramid-shaped or pyramidal protrusion and a corresponding four-sided pyramid-shaped or pyramidal indentation to provide a wall 36 having a suitable thickness as for example from 0.040 to 0.080 inches and preferably a thickness of 0.060 inches. As shown in FIG. 1, the side walls 16 and 17 are provided with five protrusions 37 and their corresponding indentations 38. Since the pyramidal-shaped protrusions 37 are truncated, there are provided planar facets 39. The planar facets 39 adjoin inclined or chamfered side surfaces 41 and 42 which are opposite each other and which are in the form of truncated triangles and inclined chamfered side surfaces 43 and 44 which are also in the form of truncated triangles.

Similarly, the third and fourth side walls 18 and 19 are provided with at least one protrusion and preferably five pyramid-shaped protrusions 46 with correspondingly pyramid-shaped indentations 47. The protrusions 46 are provided with inclined chamfered side surfaces 51 and 52 on opposite sides in the form of truncated triangles and inclined chamfered side surfaces 53 and 54 which are in the form of truncated triangles. The surfaces 44 and the side surfaces 53 face each other and are inclined at angles which are complementary to each other so that in combination they form a combined angle of 90°. Thus by way of example, the side surfaces 44 and 53 each can be inclined at an angle of 45° so that the combined angle is 90°. Similarly the side surfaces 54 on the wall 18 are inclined and the side surface 52 of the wall 17 are also inclined at angles which complement each other to form a combined angle of 90° and preferably each have an angle of 45° to form the 90° angle. Similarly the side surface 44 of the protrusions 46 on side wall 17 form complementary angles with the side surfaces 53 of the protrusions 46 on the side wall 18. Similarly, the side surfaces 44 of the protrusions 46 on the side wall 18 form a complementary angle with respect to the surface 43 of the protrusions 37 of the side wall 16.

In a similar manner, the ends walls 21 and 22 are provided with protrusions 61 with corresponding indentations 62 which are also in the shape of four-sided pyramids and which are provided with inclined or chamfered surfaces 63 and 64 in the form of truncated triangles and inclined or chamfered surfaces 66 and 67 adjoining the surfaces 63 and 64 in the form of triangles. The inclined surfaces 63 are inclined at an angle which is complementary to the angle of the inclined surfaces 41 and 42 so as to provide a combined angle of 90°. Thus they are also inclined at a suitable angle as for example 45° to provide the complementary 90° combined angle.

Cooperative frictional mating means is provided on the hereinbefore described inclined surfaces and is provided as a part of the inner structure 12 and consists of male gabled protrusions 71 and mating female recesses 72 which are mirror images of the male gabled protrusions but of a slightly smaller size so as to provide a close friction fit whey they are mated. Thus the male gabled protrusions 71 are formed on certain of the side walls whereas on the opposite side walls the female recesses 72 are formed in an aligned relationship with the protrusions 71. Thus, there is provided means forming cooperative mating frictional engagements as a part of the inner structure 12.

As shown in FIG. 1, a plurality of indentations 76 are formed in the planar facets 39 to accommodate the article to be packaged as for example a wine bottle 77 as shown in FIG. 2. As can be seen, the indentations 76 are sized to accommodate the various portions of the wine bottle 77 as for example the neck and the bottom of the bottle. After the wine bottle 77 is in place in the indentations 76 in the second side 17, the third side wall 18 can be folded upwardly on the fold line 27 to bring the adjacent surfaces 54 and 43 into engagement with each other and at the same time to cause the male gabled protrusions 71 to enter into the female recesses 72 and frictionally engage the same to provide a side wall 18 which is extending at 90° with respect to the second side 17 or the bottom wall. Thereafter, the first side 16 can be folded on the fold line 26 to cause the indentations 76 to overlie the top side of the wine bottle 77 and at the same time to cause the surfaces 44 and the surfaces 53 to come into engagement with each other and to have the male gable-like protrusions 71 frictionally engage the female recesses 72 to provide the top side which lies in the plane parallel to the plane of the bottom side 17. Thereafter the side 18 is folded along the fold line 28 to bring the surfaces 53 into engagement with the surfaces 44 with the gabled protrusions 71 frictionally entering into the female recesses 72. At the same time, the surfaces 54 are brought into engagement with the surface 53 to cause the gabled protrusions 71 to enter into the female recesses 72 and be frictionally retained therein. Completing these folds provides a four-sided container which encloses four sides of the wine bottle 77 and provides a firm shock resistant mounting for the wine bottle 77. The top and bottom ends of the wine bottle 77 are received in the end walls 21 and 22 which are folded about the fold lines 31 and 32 to cause the surfaces 63 to come in engagement with the surfaces and to cause the gable-like projection 71 to enter into the female recesses 72 and frictionally engage the same so that there is provided a six-sided molded fiber inner structure protecting the wine bottle on all sides. Visible from the outside are the indentations 38, 47 and 62 which are pyramid-shaped as hereinbefore described. Because of the use of the male gabled protrusions 71 and the female recesses 72 to frictionally retain the side walls and end walls, the inner structure 12 remains folded up without the use of an adhesive.

The molded fiber inner structure with the wine bottle 77 therein can now be wrapped with the wrapping sheet 13. The wrapping sheet or liner 13 extends over the indentations 38, 47 and 62 hereinbefore described to provide planar wall surfaces 81 which can carry printing and other graphic images. The wrapping sheet 13 is continued over all six sides of the package to provide six surfaces 81 which can be imprinted upon or which can carry graphic images. It should be appreciated that if desired the package can only be partially wrapped rather than fully wrapped.

Figure 3:
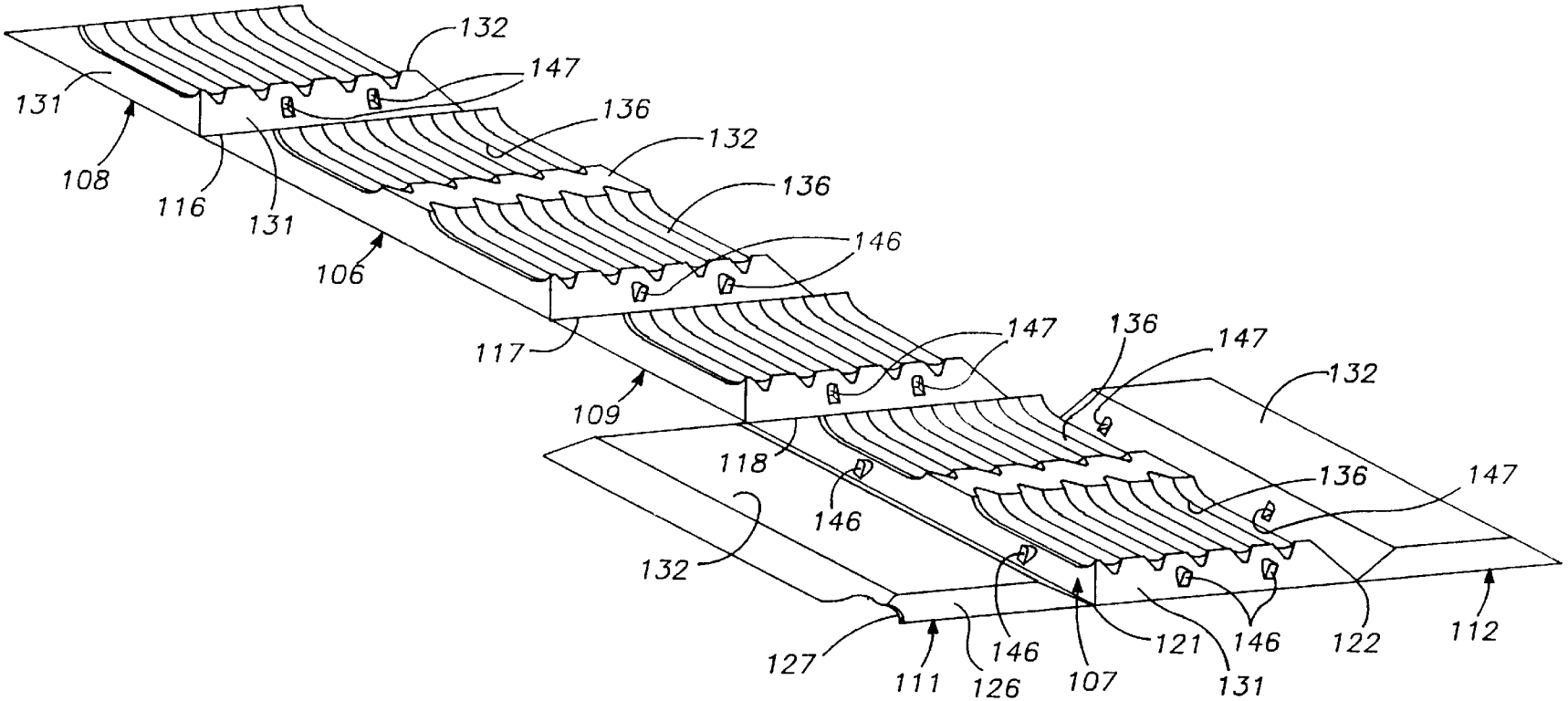
FIG. 3 is an isometric view of a molded fiber inner structure formed a flat position which can be utilized for packaging a plurality of flat containers.
Figure 4:
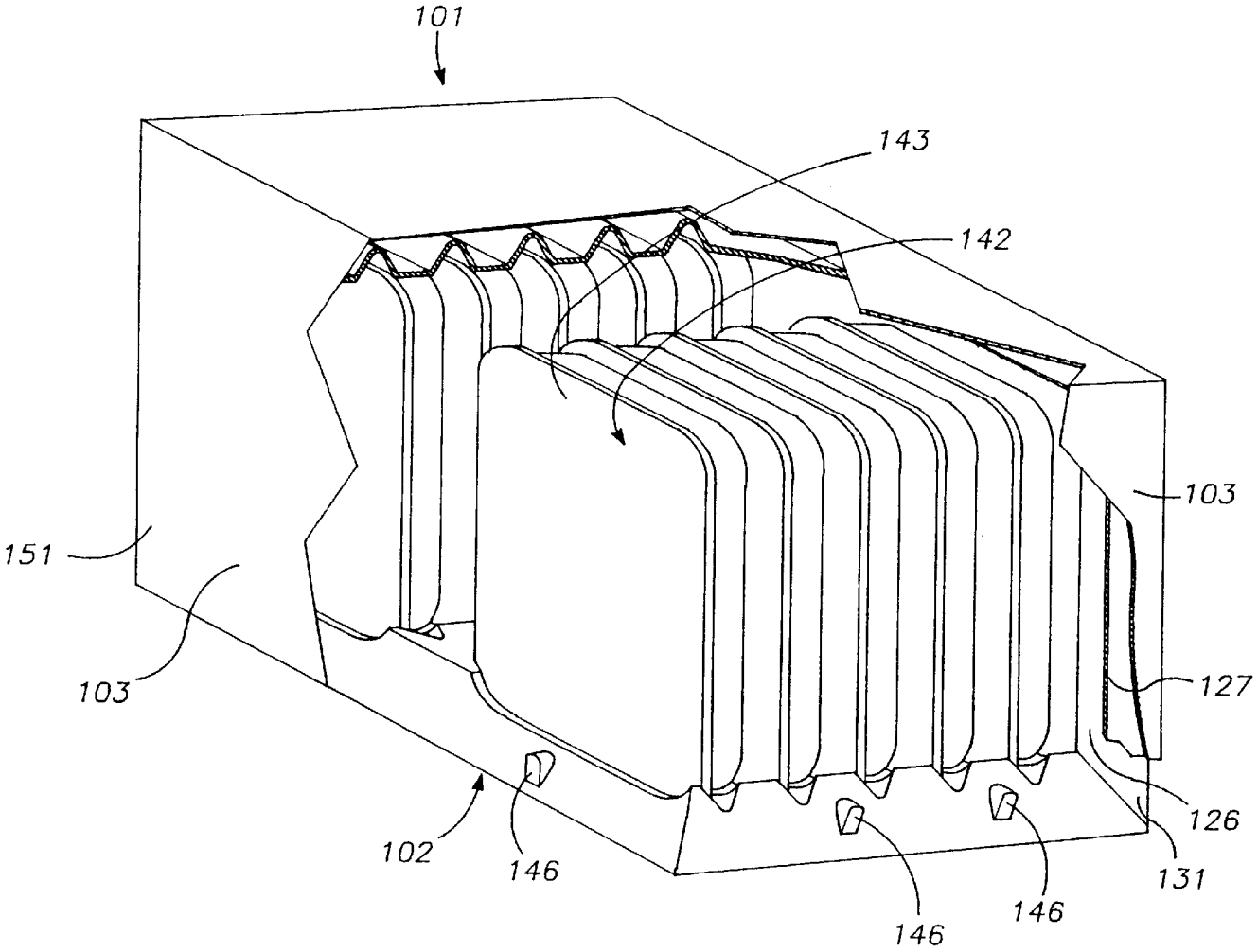
FIG. 4 is an isometric view showing a wrapped package incorporating the molded fiber inner structure shown in FIG. 3.

Another embodiment of a wrapped package incorporating the present invention is shown in the wrapped package 101 in FIGS. 3 and 4 consisting of a molded fiber inner structure 102 and an exterior wrapping sheet 103.

In FIG. 3, the molded fiber inner structure 102 is shown in an unfolded flat position and as shown therein consists of first and second or top and bottom side walls 106 and 107 which are adapted to be disposed so that they are spaced apart and parallel and third and fourth side walls 108 and 109 which are adapted to be disposed so that they are spaced apart and parallel to each other and extend at 90° angles with the top and bottom walls 106 and 107 to form a four-sided enclosure. Fifth and sixth side or end walls 111 and 112 are provided and which are adapted to be spaced apart and parallel to each other to form closures for the two open ends of the enclosure formed by the four sides 106, 107, 108 and

109. The side wall 108 is adjoined to the side wall 106 along the fold line 116. The side wall 106 adjoins the side wall 109 along the fold line 117 and the side wall 109 adjoins the side wall 107 along the fold line 118. The side wall 111 adjoins the side wall 107 along a fold line 122 and the end wall 112 adjoins the side wall 107 along the fold line 122.

Each of the walls 106, 107, 108, 109 and 111 and 112 is each provided with at least one protrusion or raised portion 126 and a corresponding indentation or recessed portion 127 which are pyramid-shaped with four sides. As hereinbefore explained in connection with the previous embodiment the inner structure is formed of a molded fiber to typically provide a wall thickness ranging from 0.040 inches to 0.080 inches and preferably a thickness of 0.060 inches. Thus all of the side walls 106, 107, 108, 109 and 111 and 112 are provided with inclined or chamfered side surfaces 131 which are inclined at an angle in excess of 30° but which is complementary to the adjacent side surfaces so that the two side surfaces have combined angles which equal 90°. Thus by way of example, one adjacent side surface can be inclined at an angle of 30° and the adjacent side surface inclined at an angle of 60° so that when the sides are folded through 90°, the two angles complement each other to provide a 90° angle to permit the side walls to extend at 90° with respect to each other. Typically and preferably, the side surfaces are inclined at 45° so that the combined angles of the adjacent side surfaces form 90° angles so that the side walls can extend at 90° angles when folded. These side surfaces 131 are in the form of truncated triangles so that planar top or inside surface 132 is provided on each of the walls 106, 107, 108, 109, 111 and 112.

Longitudinally extending V-shaped recesses 136 are formed in the walls 106, 107, 108 and 109 which extend downwardly from the planar top surfaces 132 and are adapted to receive the side margins 141 of conventional containers 142 which are square in plan and which are provided with removable covers 143. Such containers are of a type which are conventionally used for many types of food as for example cat food. As can be seen from FIGS. 3 and 4, the side walls 106 and 107 are provided with two sets of aligned spaced apart V-shaped recesses 136 to make it possible to receive two rows of such containers 142 as shown in FIG. 4. Similar V-shaped recesses 136 are provided in the side walls 108 and 109 and as shown are in alignment with the V-shaped recesses 136 and provided in the walls 106 and 107. As can be seen in FIG. 3, the end walls 111 and 112 do not have such indentations 136 and present flat surfaces to the top and bottom sides of the containers 142 when they are folded up as shown in FIG. 4.

As in the previous embodiment means is provided for detachably securing the side walls to each other so that it is unnecessary to utilize an adhesive or to minimize the amount of adhesive required to retain the molded fiber inner structure 102 in a folded up position after it has been folded about the containers 142. Gabled protrusions 146 are provided on the inclined side surfaces 131 with female recesses 147 shaped to receive the gabled protrusions 146 being provided in corresponding positions on the opposite inclined side surfaces 131 with which they are to mate and which are used to cause frictional engagement between the same to hold the side walls in position after they have been folded about the containers.

The inner structure 102 in the flat position as shown in FIG. 3 can have the containers 142 loaded into the bottom wall 107 into the spaced apart recesses 136 in a pattern as shown in FIG. 4 and thereafter utilizing automatic wrapping or folding machinery, the side wall 109 can be folded through 90° to cause the gabled protrusions 146 to enter the female recesses 147 and frictionally engage the same. Thereafter, the top wall 106 can be folded over the top of the container 142 with similar engagement of the gables or protrusions 146 into the female recesses 147 to cause frictional engagement between the same. Thereafter, the side wall 131 is folded along the fold line 116 to cover the remaining open side of the closure and to cause engagement of the gabled protrusions 146 and the female recesses 147. Thereafter or at approximately the same time, the end walls 111 and 112 can be folded upwardly to close the ends and to cause frictional engagement of the gabled protrusions 146 and the female recesses 147.

After the folding operation has been completed, the wrapping sheet 103 can be folded over the exterior of the molded fiber inner structure 102 to cover the indentations 127 and to provide smooth planar surfaces 151 which can be imprinted and which can carry other graphic material to enhance the appearance of the wrapped package.

It is apparent from the foregoing that there has been provided a wrapped package which can be fully or partially wrapped. It is rectangular in form and which can be readily stacked and palletized. The package is light in weight and has an attractive appearance. It is extraordinarily strong because of its construction so as to protect the articles or containers packaged therein from shock and damage which can occur during movement of the packaged articles from the manufacturer to the consumer. The package is of a type which can be readily opened and can be readily disposed of for recycling. The indentations provided in the insert in the packaging provide the basis for the increased strength in the packaging. Although the indentations take some space, the space required for these indentations can be relatively small as for example as shown in the embodiments in FIGS. 3 and 4 so there is very little loss of space. In the wrapped package construction of the present invention, the exterior surface liner or wrapping sheet which is utilized takes the place of the conventional corrugated carton which is utilized in packaging, thereby making approximately a two-thirds saving in the amount of paper material required. The liner can be adhered utilizing natural glues as for example a cornstarch-based glue so that packaging can be readily recycled. Thus the wrapped package of the present invention, in addition to providing a packaging which is environmentally very desirable, also reduces the costs of packaging.

What is claimed:

1. A wrapped package for carrying printing and other graphic images and for at least one product to be packaged comprising a molded fiber inner structure to provide a six-sided folded up rectangular package and sheet material enclosing said inner structure and providing planar surfaces on which the printing and other graphic images can appear, said molded fiber inner structure comprising first and second spaced-apart parallel side walls, third and fourth spaced-apart parallel side walls, said first and second side walls extending at 90° angles with respect to said third and fourth side walls, fifth and sixth spaced-apart parallel end walls extending at 90° angles with respect to said first and second and third and fourth side walls, each of said side and end walls having at least one raised protrusion and a pyramidal indentation therein to provide four inclined side surfaces inclined at angles in excess of 30° and complementary to the angles of adjacent inclined side surfaces to provide combined angles of 90°, said raised protrusions having recesses therein receiving the product so that the product is surrounded by the molded fiber inner structure, said sheet material overlying and enclosing the pyramidal indentations on all sides of the six-sided inner structure and means forming cooperative mating frictional engaging members carried on said inclined side surfaces and being frictionally engaged with said side and end walls being disposed at 90° with respect to each other and serving to retain the product between the side and end walls.

2. A wrapped package as in claim 1 wherein each of said side and end walls is provided with a plurality of spaced apart raised pyramidal protrusions and wherein said recesses are formed in a plurality of spaced-apart raised pyramidal protrusions.

3. A wrapped package as in claim 2 wherein said protrusions have a wall thickness ranging from 0.040 inches to 0.080 inches.

4. A package as in claim 3 wherein said wall thickness is approximately 0.060 inches.

5. A package as in claim 2 wherein at least certain of said side and end walls are adjoined along fold lines.

6. A molded fiber structure comprising a sheet of molded fiber comprising first, second, third and fourth side walls adjoined to each other along fold lines to provide a continuous generally flat sheet, and fifth and sixth end walls adjoining at least one of the side walls and lying in the same plane of the flat sheet, each of said side and end walls having outer inclined side surfaces which are inclined at an angle in excess of 30°, the adjacent surfaces being inclined at a complementary angle so that the combined angles of adjacent surfaces is equal to 90°, each of said side and end walls having at least one raised pyramidal protrusion, said pyramidal protrusion having at least one recess therein for receiving a product to be packaged and means forming cooperative mateable frictional engaging members provided on said outer inclined side surfaces and adapted to mate when the side walls are folded at angles with respect to each other.

7. A structure as in claim 6 wherein each of said side walls is provided with a plurality of spaced apart parallel protrusions.

8. An insert as in claim 7 wherein said side and end walls are provided with pyramidal protrusions opposite the pyramidal protrusions in each of said side and end walls.

9. A method for wrapping a product into a wrapped package carrying printing and graphic images thereon utilizing an insert formed of molded fiber and having first, second, third and fourth side walls and fifth and sixth end walls with each of the side and end walls having a raised protrusion with at least certain of the pyramidal protrusions having recesses therein formed to accommodate the product to be packaged, the method comprising the steps of placing the product in at least certain of the recesses, folding the insert about the product so that the adjacent side walls extend at 90° with respect to each other to form a four-sided enclosure and folding the end walls so that they extend at 90° angles with respect to the side walls to form a six-sided enclosure enclosing the product and wrapping the insert with the product therein with a sheet material to provide a six-sided package having planar wall surfaces for the printing and graphic matter and providing cooperative frictional mating members on the protrusions and causing engagement of the cooperative frictional mating members when the side and end walls are folded to form the enclosure to thereby retain the enclosure so that it retains the product therein.

10. A molded fiber structure for packaging a product comprising first and second spaced-apart parallel side walls and third and fourth spaced-apart parallel side walls, said first and second side walls extending at 90° angles with respect to said third and fourth side walls, fifth and sixth spaced-apart parallel end walls extending at 90° with respect to the first and second and third and fourth side walls, each of said side walls and end walls having at least one pyramidal protrusion and a pyramidal indentation therein in registration with the pyramidal protrusion to provide four inclined side surfaces inclined at angles in excess of 30° complementary to the angles of adjacent inclined side surfaces to provide combined angles of 90°, said protrusions having recesses therein for receiving the product so that the product is surrounded by the molded fiber and means forming cooperative mateable frictional engaging members carried on said inclined side surfaces becoming frictionally engaged when said side and end walls are disposed at 90° with respect to each other during erection and serving to retain the product between the side and end walls after erection.

11. A structure as in claim 10 wherein at least certain of said cooperative mateable frictional engaging members are in the form of male gabled protrusions and mateable female recesses which are mirror images of the male gabled protrusions but being of a slightly smaller size so as to provide a close frictional fit between the male gabled protrusion and the mateable female recess.

* * * * *